US012745800B2

(12) United States Patent
Lyell et al.

(10) Patent No.: US 12,745,800 B2
(45) Date of Patent: Sep. 29, 2026

(54) AEROSOL GENERATION DEVICE WITH SLEEVE COVER

(71) Applicant: JT International SA, Geneva (CH)

(72) Inventors: Nathan Lyell, Woking (GB); Monique Spoerri, London (GB); Marko Plevnik, London (GB); Akira Yamaguchi, Geneva (CH); Ryo Hasegawa, Geneva (CH); Layth Sliman Bouchuiguir, Bellevue (CH); Yusuke Kayama, Tokyo (JP)

(73) Assignee: JT International SA, Geneva (CH)

( * ) Notice: Subject to any disclaimer, the term of this patent is extended or adjusted under 35 U.S.C. 154(b) by 667 days.

(21) Appl. No.: 18/030,377

(22) PCT Filed: Oct. 6, 2021

(86) PCT No.: PCT/EP2021/077493

§ 371 (c)(1),
(2) Date: Apr. 5, 2023

(87) PCT Pub. No.: WO2022/074027

PCT Pub. Date: Apr. 14, 2022

(65) Prior Publication Data

US 2023/0276851 A1 Sep. 7, 2023

(30) Foreign Application Priority Data

Oct. 6, 2020 (EP) ..... 20200294

(51) Int. Cl.

| | |
|---|---|
| ***A24F 40/46*** | (2020.01) |
| ***A24F 40/20*** | (2020.01) |
| ***A24F 40/40*** | (2020.01) |

(52) U.S. Cl.
CPC ..... *A24F 40/46* (2020.01)

(58) Field of Classification Search
CPC ..... A24F 40/40
See application file for complete search history.

(56) References Cited

U.S. PATENT DOCUMENTS

| | | | | |
|---|---|---|---|---|
| 4,213,707 | A * | 7/1980 | Evans, Jr. | G01B 11/105 356/429 |
| 2014/0060554 | A1* | 3/2014 | Collett | A24F 40/30 392/386 |
| 2019/0254346 | A1* | 8/2019 | Hepworth | A61M 15/06 |

FOREIGN PATENT DOCUMENTS

| | | | |
|---|---|---|---|
| JP | 2015532828 | A | 11/2015 |
| JP | 2019528714 | A | 10/2019 |
| WO | 2016023175 | A1 | 2/2016 |

(Continued)

OTHER PUBLICATIONS

International Search Report for Application No. PCT/EP2021/077493 mailed Dec. 10, 2021, 2 pages.

*Primary Examiner* — Philip Y Louie
*Assistant Examiner* — Charlotte Davison
(74) *Attorney, Agent, or Firm* — Lerner David LLP

(57) ABSTRACT

The present invention relates to an aerosol generation device with a sleeve cover. More specifically, an aerosol generation device includes: an aerosol generation chamber configured to receive and heat a substrate to generate aerosol, wherein the aerosol generation chamber has an upper portion, a lower portion and an expansion mechanism; and a cover having a covering position and a non-covering position.

13 Claims, 4 Drawing Sheets

(56) References Cited

FOREIGN PATENT DOCUMENTS

| | | | |
|---|---|---|---|
| WO | 2018050610 | A1 | 3/2018 |
| WO | 2020079226 | A1 | 4/2020 |

* cited by examiner

AEROSOL GENERATION DEVICE WITH SLEEVE COVER

CROSS-REFERENCE TO RELATED APPLICATIONS

The present application is a national phase entry under 35 U.S.C. § 371 of International Application No. PCT/EP2021/077493 filed Oct. 6, 2021, which claims priority from European Application No. 20200294.5 filed Oct. 6, 2020, all of which are incorporated herein by reference.

TECHNICAL FIELD

The present disclosure relates to an aerosol generation device in which an aerosol generating substrate is heated to form an aerosol; more specifically, to an aerosol generation device with a sleeve cover.

BACKGROUND

The popularity and use of aerosol generation devices (also known as heat-not-burn products or vaporizers or E-cigarette) has grown rapidly in the past few years. Various devices and systems are available that heat or warm aerosolisable substances as opposed to burning tobacco in conventional tobacco products.

A commonly available reduced-risk or modified-risk device is the heated substrate aerosol generation device or heat-not-burn device. Devices of this type generate an aerosol or vapor by heating an aerosol substrate that typically comprises moist leaf tobacco or other suitable aerosolisable material to a temperature typically in the range 150° C. to 350° C. Heating an aerosol substrate, but not combusting or burning it, releases an aerosol that comprises the components sought by the user but not the toxic and carcinogenic by-products of combustion and burning. Furthermore, the aerosol produced by heating the tobacco or other aerosolisable material does not typically comprise the burnt or bitter taste resulting from combustion and burning that can be unpleasant for the user and so the substrate does not require the sugars and other additives that are typically added to such materials to make the smoke and/or vapor more palatable for the user.

In such devices, the substrate is usually contained substantially in an aerosol generation chamber for heating, and the user usually needs to push a button to eject the substrate out of the aerosol generation chamber after consuming for changing to a new substrate. However, arranging buttons on the device may decrease the ingress of the housing of the aerosol generation device, and may complex the operation of the device for the user. It is therefore desirable to provide a convenient way of replacing the aerosol substrate in the heating chamber. Additionally, it is also desirable to increase the aerosol yield from aerosolisable material.

SUMMARY OF THE INVENTION

The present invention provides a smoking article for an aerosol generation device, which solves some of or all of the above-mentioned problems.

A 1st embodiment of the invention is directed to an aerosol generation device comprising:

an aerosol generation chamber configured to receive and heat a substrate to generate aerosol, wherein the aerosol generation chamber comprises an upper portion, a lower portion and an expansion mechanism, wherein the aerosol generation chamber can be in a closed state in which a surfaces of the upper portion and a surface of the lower portion substantially enclose a volume containing the substrate for consuming the substrate, and in an open state in which the surface of the upper portion and the surface of the lower portion are distanced from each other by the expansion mechanism, so that the substrate can be received by or removed from the chamber; and a cover having a covering position and a non-covering position; wherein when the cover is in the non-covering position, the volume inside the aerosol generation chamber is exposed and the aerosol generation chamber is in the open state, and when the cover is in the covering position, the aerosol generation chamber is covered by the cover and is in the closed state.

The expansion mechanism improves the convenience of using and replacing the aerosol substrate for the user. The chamber containing the substrate can be easily opened by just sliding the cover. This provides an intuitive and robust way to replace the substrate, and also a simple inner structure of the aerosol generation device.

According to a 2nd embodiment, in the 1st embodiment, the expansion mechanism is configured with repelling magnets, springs, or a clip providing an expansion force so as to distance the planar surface of the upper portion from the planar surface of the lower portion when the cover is moved from covering position to the non-covering position.

With this arrangement, the aerosol generation chamber can be opened automatically.

According to a 3rd embodiment, in any one of the preceding embodiments, the cover is engaged with the upper portion so as to transition the aerosol generation chamber from the open state to the closed state or vice versa when the cover moves from the covering position to the non-covering position or vice versa.

According to a 4th embodiment, in any one of the preceding embodiments, the cover is configured to slide on a main body of the aerosol generation device and is slidingly engaged with the upper portion of the aerosol generation chamber, so that the cover is able to press down the upper portion or release the upper portion so as to bring the upper portion closer to the lower portion or distance it from the lower portion via the expansion mechanism when sliding on the main body.

According to a 5th embodiment, in any one of the preceding embodiments, an upper surface of the upper portion is configured to connect with the cover, and the upper surface is an inclined and/or curved surface, so that the upper portion can be pressed down so as to substantially enclose the substrate by the cover in the covering position, and can be released from the pressure of the cover through sliding the cover to its non-covering position.

According to a 6th embodiment, in the preceding embodiment, the expansion mechanism comprises a spring steel framework arranged between the upper portion and the lower portion, which is configured to receive and hold the substrate.

According to a 7th embodiment, in the preceding embodiment, the spring steel framework comprises an ejection plate configured to at least partially push the substrate out of the aerosol generation chamber when the aerosol generation chamber is opened.

With the ejection plate, the substrate can be lifted from the heating elements when the chamber opens so as to cool down the substrate.

According to an 8th embodiment, in any one of the 6th or 7th embodiments, the spring steel framework is made of a steel frame or plate having a predetermined angle, and can be compressed by an outer force.

According to a 9th embodiment, in any one of the preceding embodiments, the aerosol generation chamber comprises heating elements on the upper portion and/or the lower portion, for heating the substrate.

According to a loth embodiment, in any one of the 6th to 9th embodiments, an attaching surface of the spring steel framework is attached to the upper portion, and a holding surface of the spring steel framework for holding the substrate is arranged opposite to the attaching surface, so that the holding surface is able to be sprung away from the heating element of the upper portion when the aerosol generation chamber is opened.

With this arrangement, the substrate can be distanced from the heating element when the chamber opens so as to cool down the substrate.

According to an nth embodiment, in any one of the 5th to 9th embodiments, an ejection plate forms a leaf or flat spring attached with the steel spring framework, so as to push the substrate from the steel spring framework.

According to a 12th embodiment, in any one of the preceding embodiments, the spring steel framework is slidingly attached to the upper portion so that the spring steel framework is removable from the aerosol generation chamber.

With this arrangement, the user can clean both the framework and the heating elements easily.

According to a 13th embodiment, in any one of the preceding embodiments, the lower portion and/or the upper portion are rotationally hinged in the device.

According to a 14th embodiment, in any one of the preceding embodiments, the cover comprises a restriction portion for pushing the substrate into the aerosol generation chamber and fully maintaining the substrate in the aerosol generation chamber.

With this arrangement, the substrate can be fixed and substantially contained in the aerosol generation chamber so as to be heated completely.

According to a 15th embodiment, in any one of the preceding embodiments, the substrate is compressed when the aerosol generation chamber is in the closed state.

This arrangement provides a better aerosol generation performance of the substrate.

Preferred embodiments are now described, by way of example only, with reference to the accompanying drawings.

DETAILED DESCRIPTION OF THE PREFERRED EMBODIMENTS

Preferred embodiments of the present invention are described hereinafter and in conjunction with the accompanying drawings.

As used herein, the term "aerosol generation device" "vaporizer system", "inhaler" or "electronic cigarette" may include an electronic cigarette configured to deliver an aerosol to a user, including an aerosol for smoking.

Figure 1:
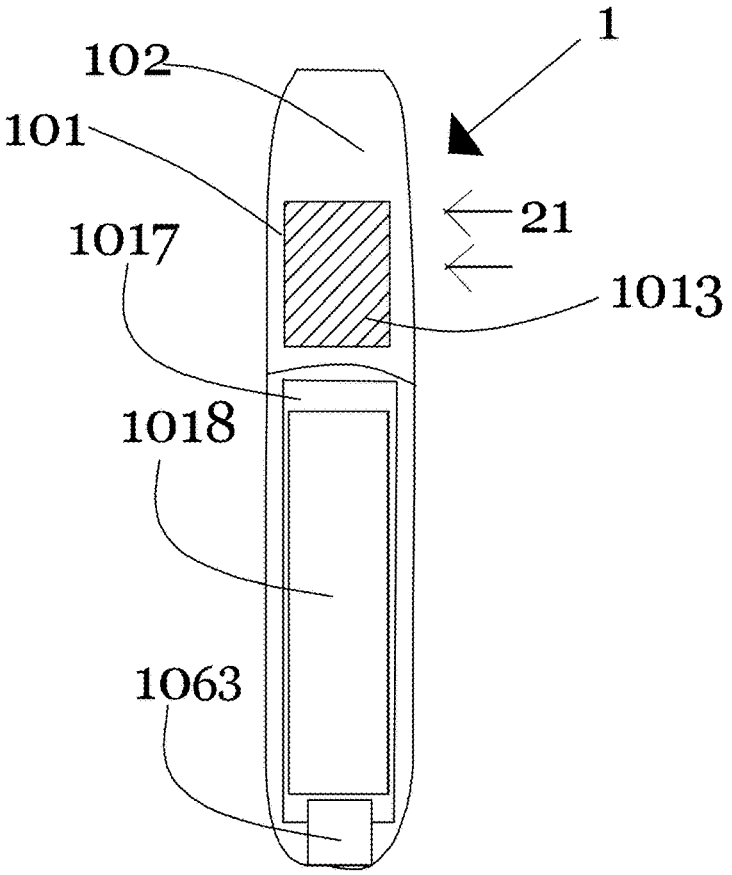
FIG. 1: is an exposing schematic illustration (cross-sectional view) of an aerosol generation device with an expansion mechanism according to an exemplary embodiment of the present invention.

The electronic cigarette 1 of this invention has a substantially elongated shape. The surfaces of the device 1 perpendicular to the insertion direction of the substrate 2 are regarded as the side surfaces of the aerosol generation device 1 and the surfaces parallel to the insertion of the substrate 2 as the main surfaces. The surface of the mouthpiece perpendicular to the main surface of the device 1 is regarded as the top surface, and the opposite surface of the device 1 as the bottom surface. FIG. 1 shows a schematic illustration view of the device 1 looking onto the main surface. The substrate 2 is inserted into the device from the side surface side. The direction parallel to the insertion direction is regarded as the transverse direction and the direction perpendicular to the insertion direction 21 as the longitudinal direction.

Referring to the drawings and in particular to FIG. 1, an electronic cigarette 1 for consuming a substrate 2 is illustrated from a frontal view, or the view from the aspect of the main surface of the device 1. The electronic cigarette 1 can be used as a substitute for a conventional cigarette, and comprises a cover 102, and a main body. The cover 102 is slidingly engaged with the main body 106 via a slide track (not shown) and functions as the mouthpiece for the user. The cover 102 is arranged to slide in a longitudinal direction of the aerosol generation device 1. The main body comprises an aerosol generation chamber 101, a LiPo battery 1018, a PCBA 1017 comprising a controller or a CPU, and a USB-C connector 1063 for charging the LiPo battery 1061 and/or transmitting data to the device 1.

Figure 2:
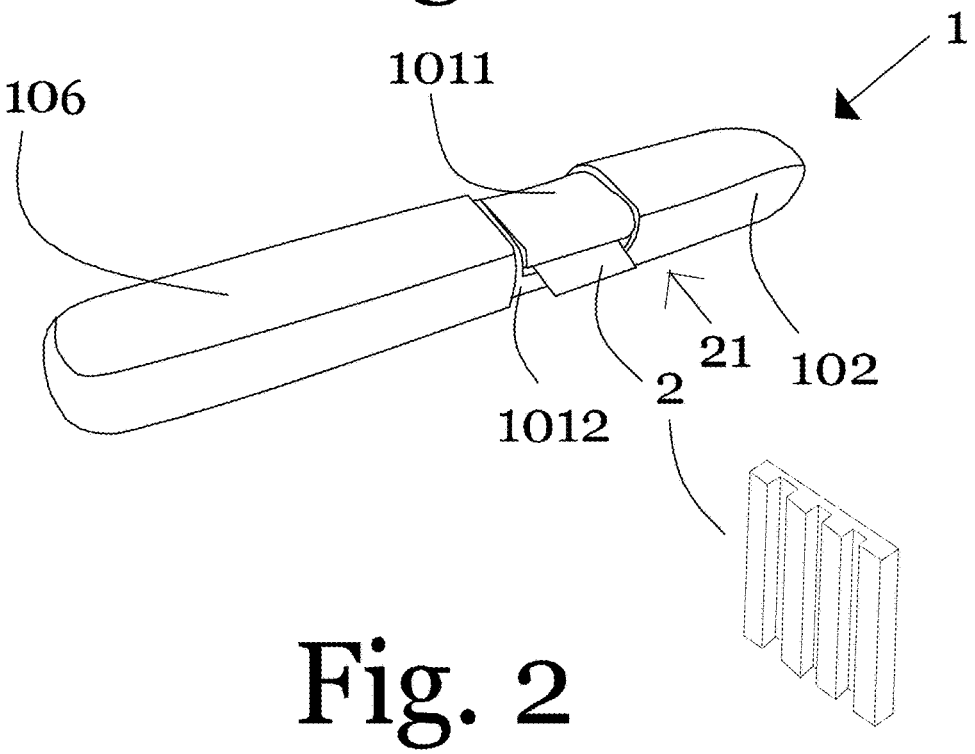
FIG. 2: is a schematic illustration of the aerosol generation device with the expansion mechanism in an open state and a substrate according to the exemplary embodiment of the present invention.

Referring to both FIGS. 1 and 2, the aerosol generation chamber 101 is arranged at or adjacent to the top end of the main body of the device 1. With the sliding movement, the cover 102 has a covering position and an uncovering position. In the covering position, the aerosol generation chamber 101 can be covered or sleeved by the cover 102. In the uncovering position, a space or an inside volume of the aerosol generation chamber 101 is exposed for receiving and discarding the substrate 2. When being consumed, the substrate 2 is contained and heated in the aerosol generation chamber 101 for generating aerosol.

A schematic perspective illustration of the aerosol generating substrate 2 is shown in FIG. 2. The substrate 2 may for example comprise nicotine or tobacco, and an aerosol former. Tobacco may take the form of various materials such as shredded tobacco, granulated tobacco, tobacco leaf and/or reconstituted tobacco. Suitable aerosol formers include: a polyol such as sorbitol, glycerol, and glycols like propylene glycol or triethylene glycol; a non-polyol such as monohydric alcohols, acids such as lactic acid, glycerol derivatives, esters such as triacetin, triethylene glycol diacetate, triethyl citrate, glycerin or vegetable glycerin. In some embodiments, the aerosol generating agent may be glycerol, propylene glycol, or a mixture of glycerol and propylene glycol. The substrate 103 may also comprise at least one of a gelling agent, a binding agent, a stabilizing agent, and a humectant.

The substrate 2 is porous such that air can flow through the substrate 2 and collect aerosol as it does so. The substrate 2 may for example be a foam, or packed strands or fibres. The substrate 2 may be formed through an extrusion and/or rolling process into a stable shape. The aerosol generating substrate 2 may be shaped to provide one air flow channel on one side or, in the preferred embodiments, multiple air flow channels as shown in FIG. 1, more preferably, on both sides. These can be aligned with the air flow channel of the aerosol generating device 1 in order to increase air flow through the aerosol generation chamber 101. The substrate 103 is exposed with a bare external surface. Alternatively, the substrate 2 may comprise an air permeable wrapper covering at least part of a surface of the substrate 2. The wrapper may, for example, comprise paper and/or non-woven fabric.

In the present embodiment, the substrate may have a substantially flat cuboid shape or a pod shape having a size of 18×12×1.2 mm, with each of length, width and depth of the cuboid being selected within a range of +/−40%, for example. Generally, the length of the substrate in the preferred embodiments is between 40 and 10 mm, preferably between 30 and 12 mm, more preferably between 25 and 14 mm, and most preferably between 22 and 15 mm. The width of the substrate in the preferred embodiments is between 30 and 6 mm, preferably between 25 and 8 mm, more preferably between 20 and 9 mm, and most preferably between 16 and 9 mm. The height of the substrate in the preferred embodiments is between 3 and 0.5 mm, preferably between 2 and 0.6 mm, more preferably between 1.8 and 0.8 mm, and most preferably between 1.6 and 0.9 mm.

The length and/or the width of the volume for containing the substrate 2 inside the aerosol generation chamber 101 are configured to be preferably larger than or equal to the length of the substrate 2 in the longitudinal direction and transverse direction, so that the substrates can be fully contained in the aerosol generation chamber 101 when the cover 102 is in the covering position. The depth of the volume is equal to and preferably less than the depth of the substrate 2, so as to improve the aerosol generation performance. In other words, the volume inside the aerosol generation chamber 101 has a substantially cuboid shape corresponding the shape of the substrate 2, with the size of e.g. 18×12×1.2 mm, with each of length, width and depth of the cuboid being selected within a range of +/−40%. In this case, the length and the width of the volume inside the aerosol generation chamber is preferably larger than 18 mm and 12 mm, respectively and the depth of the volume inside the aerosol generation chamber 107 is preferably less than 1.2 mm. More specifically, the length of the volume in the aerosol generation chamber in the preferred embodiments is between 41 and 10 mm, preferably between 31 and 12 mm, more preferably between 26 and 14 mm, and most preferably between 23 and 15 mm. The width of the volume in the aerosol generation chamber 101 in the preferred embodiments is between 32 and 6 mm, preferably between 27 and 8 mm, more preferably between 23 and 9 mm, and most preferably between 20 and 9 mm. The depth of the chamber 101 in the preferred embodiments is between 2.9 and 0.5 mm, preferably between 1.9 and 0.6 mm, more preferably between 1.5 and 0.8 mm, and most preferably between 1.3 and 0.9 mm.

The aerosol generation chamber 101 comprises an upper portion ion, a lower portion 1012, and an expansion mechanism 1013. When being consumed, the substrate 2 is contained in the volume or space enclosed by the upper portion 1011 and the lower portion 1012 (namely the main surfaces having a relevantly bigger area of the substrate 2, and facing the main surfaces of the substrate 2 parallel to the insertion direction of the substrate 2) together with other surfaces (namely side surfaces having a relevantly smaller area of the substrate 2, and facing the side surfaces of the substrate 2 perpendicular and/or parallel to the insertion direction of the substrate 2) of the upper portion 1011 and/or the lower portion 1012 and/or the cover 102, in the present embodiment, three side surfaces of the lower portion 1012 and an inner surface of the cover 1012 when in the covering position of the cover 102. Specifically, the substrate 2 is compressed by inner planer surfaces 1014, 1015 comprised by the upper portion 1011 and the lower portion 1012. At least one heating element 1016 is comprised by at least one of the planer surfaces 1014, 1015. Preferably, a heating element 1016 is arranged on each of the planer surfaces 1014, 1015 of the upper portion 1011 and the lower portion 1012. In some embodiments, compression alone may be sufficient to cause the release of the aerosol from the substrate 2. However, in many embodiments, the heating element 1016 is arranged to supply heat to the substrate 2 in order to generate the aerosol. In such embodiments, the application of pressure increases the yield of aerosol from the aerosol generating substrate 2 compared to heating alone. With the compression structure with two heating elements 1016 of the present embodiment, the heating element 1016 may, for example, be a plate comprising a resistive track that is powered by electricity.

Hence, the aerosol generation chamber 101 can be in a closed state when the cover is in the non-covering position, namely the upper portion 1011 and the lower portion 1012 are substantially attached together, and both substantially enclose the substrate 2 in the volume inside of the aerosol generation chamber. More specifically, the planar surfaces 1014, 1015 of the upper portion 1011 and the lower portion 1012 both substantially enclose and preferably compress the substrate 2.

In preferred embodiments, when the aerosol generation chamber 101 is in the closed state, the surface 1014 of the upper portion 1011 touches a surface of the lower portion 1012. Specifically, in the present embodiment, the lower portion 1012 has a cuboid hollow which forms at least a part of the volume containing the substrate 2. The volume is surrounded with surfaces 1041, 1042 of the lower portion 1012. A surface 104 of the lower portion 1012, which is not hollowed and substantially parallel to the planar surfaces 1015 of the lower portion 1012, touches the surface 1014 of the upper portion 1011 when the aerosol generation chamber 101 is in the closed state. In some embodiments, an edge at one side of the upper surface 1011, which is opposite to the hinged side, has a narrow surface along the direction perpendicular to the insertion direction of the substrate 2, not shown in the figures, touches the surface 1015 of the lower portion 1012 when the aerosol generation chamber 101 is in the closed state. Therefore, in some embodiments, when the aerosol generation chamber 101 is in a closed state, at least one planar surface of the upper portion 1011 touches at least one planar surface of the lower portion 1012.

The expansion mechanism 1013 in the aerosol generation chamber 101 is arranged in a way that the aerosol generation chamber 101 can be in an open state in which the aerosol generation chamber 101 is opened and expanded, and the upper portion 1011 and the lower portion 1012 are distanced from each other. More specifically, the upper portion 1011 is distanced from its closed position, at which the upper portion 1011 is when the aerosol generation chamber 101 is in the closed state, by the expansion mechanism 1013. More specifically, the planar surface 1016 of the upper portion 1011 and a planar surface 1016 of the lower portion 1012 are distanced from each other by the expansion mechanism 1013 so that the substrate 2 can be received by or removed from the aerosol generation chamber 101.

Figure 3A:
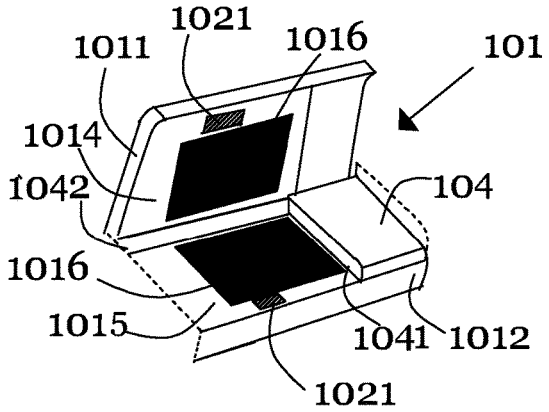
FIGS. 3*a* to 3*c*: show schematic views and partial schematic views (cross-sectional views) of the aerosol generation chambers of the aerosol generation devices according to different exemplary embodiments of the present invention.
Figure 3B:
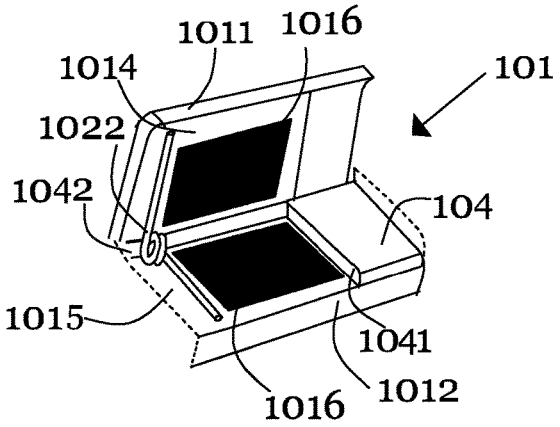
Figure 3C:
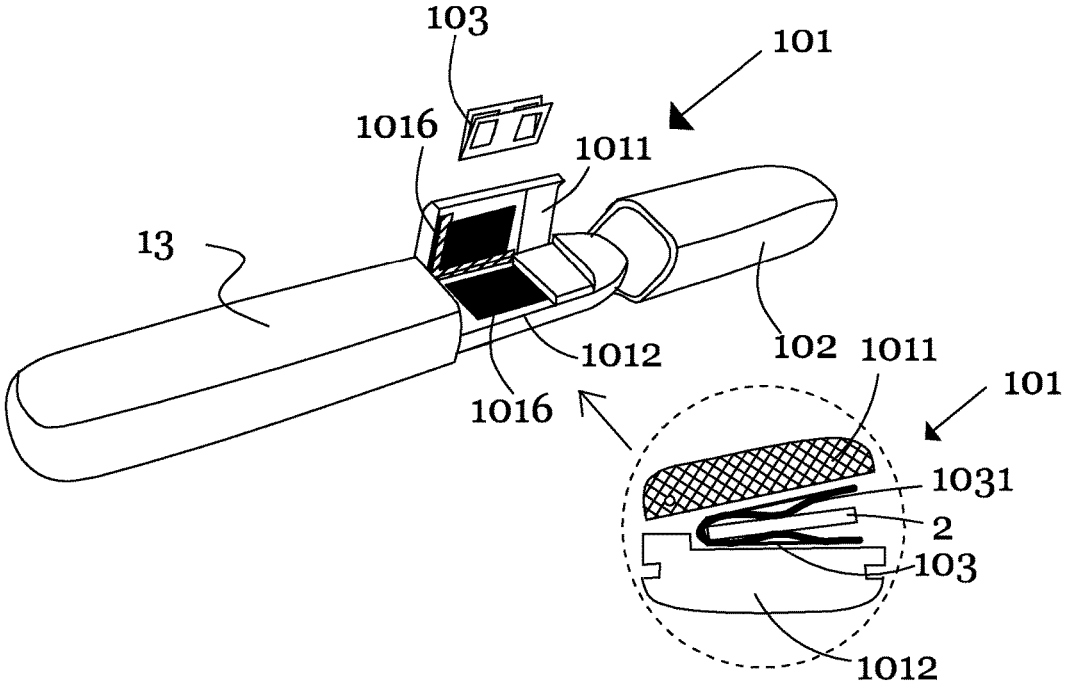

Specifically, as shown in FIGS. 3*a* to 3*c*, the upper portion 1011 is rotationally hinged in the main body of the device 1, while the lower portion 1011 is fixed in the main body of the device 1, or is integrated with a housing of the main body of the device 1. A heating plate 1016 (marked with solid black in the figures) is arranged on each of the inner planner surfaces 1014, 1015 of the upper portion 1011 and the lower portion 1012.

When being consumed, the substrate 2 is compressed in the volume enclosed by the heating elements 1016 with the closure of the upper portion 1011 and lower portion 1012. The closure of the upper portion 1011 and lower portion 1012 is caused by the sleeving of the cover 102.

With the arrangement of the expansion mechanism 1013, the aerosol generation chamber 101, more specifically the upper portion in the present embodiments, is gradually expanded by a repelling or an expansion force from the expansion mechanism 1013 by the releasing of the cover 102 from the covering position to the non-covering position. In one embodiment, as shown in FIG. 3*a*, the expansion mechanism 1013 may comprise two repelling magnets 1021 arranged adjacent to the open side of the aerosol generation chamber 101 opposite to the hinged side of the aerosol generation chamber 101. In another embodiment, as shown in FIG. 3*b*, the expansion mechanism 1013 may comprise a torsion spring 1022 arranged in or attached to the upper portion 1011 and the lower portion 1012. In a preferred embodiment, the expansion mechanism 1013 may be a spring steel framework 103. The spring steel framework 103 is configured to be set between the upper portion 1011 and the lower portion 1012. The spring steel framework 103 has a book-like shape.

Specifically, it is made of a steel frame or plate with a predetermined angle, which is large enough to receive or release the substrate 2 into or out of the aerosol generation chamber 101. The spring steel framework 103 can be compressed by an outer closure force by the pressure of the upper portion 1011 and lower portion 1012 caused by the cover 102. The steel framework 103 can be taken out of the aerosol generation chamber 101 for cleaning. Slots (not shown) may be arranged on the upper portion 1011 and/or the lower portion 1012 so as to fix the steel spring framework 103 by slidingly attaching the steel spring framework 103 to the slots. In a preferred embodiment, magnets may be arranged in the aerosol generation chamber 101 for fixing the steel spring framework 103. Seals (shown with slashes in FIG. 3*c*) may also be arranged on two, preferably three sides around the heating elements 1016 so as to maintain the substrate 2 in the area of the heating elements, insulate the heat, and guide the generated smoke towards the outlet and/or inlet of the device 1.

An enlarged cross-section view of the aerosol generation chamber 101 with steel spring framework 103 is shown in the dashed circle in FIG. 3*c*. The upper portion 1011 is distanced from the lower portion 1012 by the expansion force exercised by the steel spring framework 103. Inside the steel spring framework 103 (shown with a thick line), an ejection plate 1031 (shown with a thicker line) is arranged and configured to push the substrate 2 away from both of the heating elements 1016 and the reflector plate, arranged in the chamber 101, so as to unstick the substrate 2 for discarding it from the heating elements 1016 and for and cooling it down. The ejection plate 1031 is a leaf spring made of a spring steel plate curved and attached with the steel spring framework 103.

In case that only one heating element 1016 is arranged on the planner surface 1014 of the upper portion 1011 or the planner surface of the lower portion 1012, the steel spring framework 103 may be only attached to the surface of the aerosol generation chamber 101 having the heating element 1016, and may have a slot or other fixation means to contain or hold the substrate 2. With this arrangement, when aerosol generation chamber 101 is in the open state, in other words, the planner surface 1014 of the upper portion 1011 is distanced from the planner surface of the lower portion 1012, the substrate 2 can also be distanced from the heating element 1016 for cooling down.

Figure 4A:
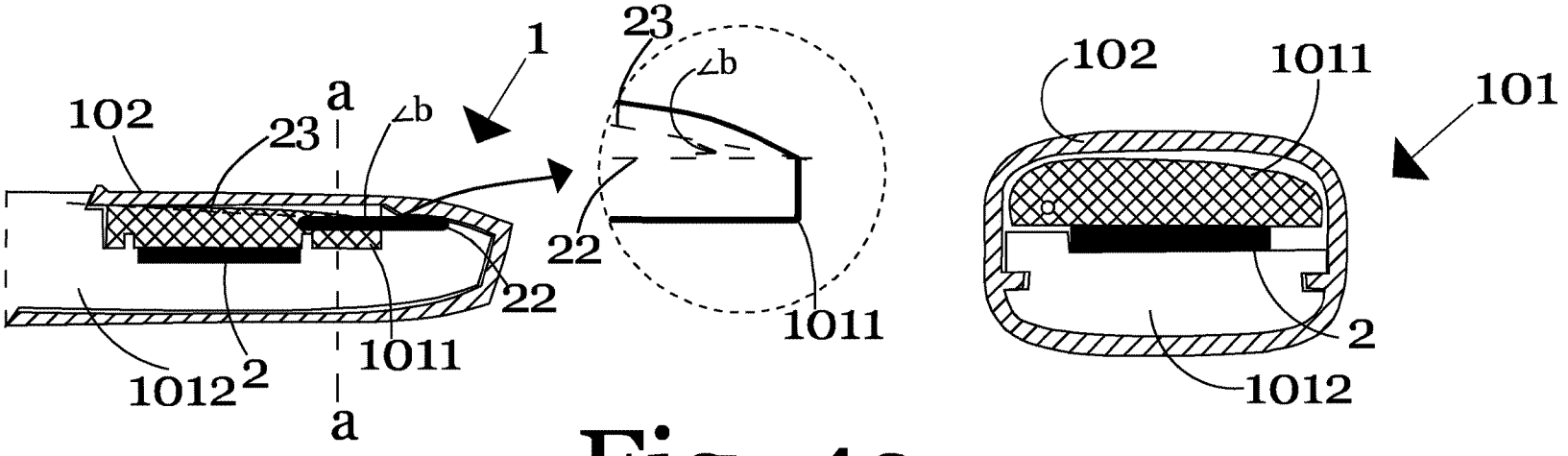
FIGS. 4*a* and 4*b*: show exposed schematic views (cross-sectional views) of the aerosol generation chambers of the aerosol generation devices according to the exemplary embodiment of the present invention.
Figure 4B:
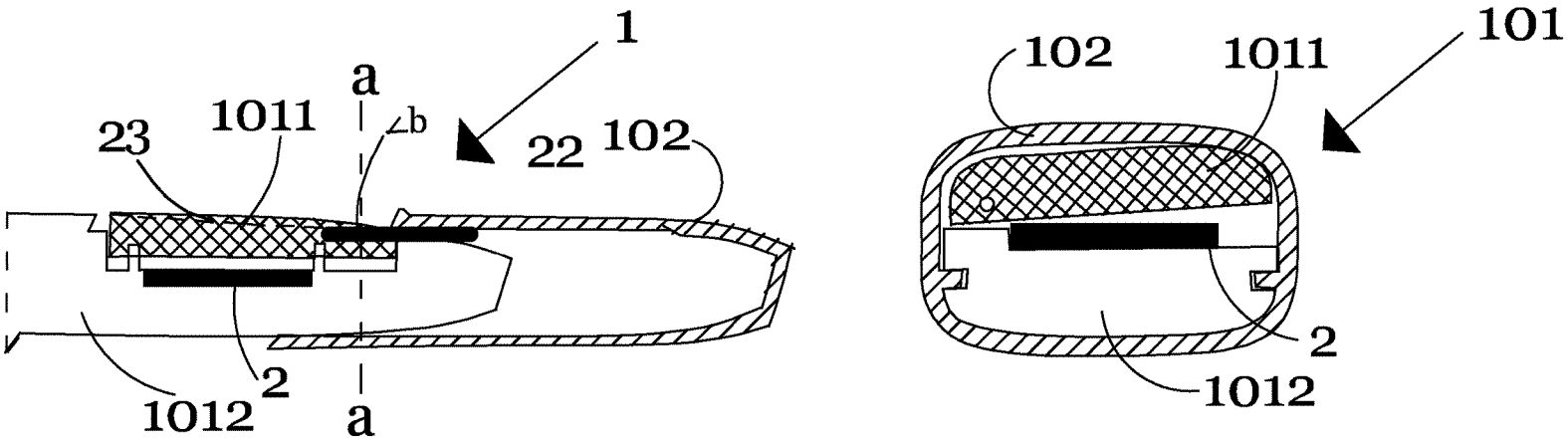

FIGS. 4*a* and 4*b* show cross-section views of the aerosol generation chamber 101 looking onto the side surface of the device 1, and the cross-section views of the aerosol generation chamber 101 at the Section Line a-a (shown in dashed lines) looing onto the aspect of the top surface.

FIG. 4*a* shows the aerosol generation chamber 101 in the closed state and the cover 102 in the covering position.

The surface of the upper portion 1011 configured to connect with the cover 102 is regarded as the upper surface of the upper portion 1011. The upper surface is an inclined and/or curved surface. The upper surface is inclined between and/or has a curvature across the covering position and the non-covering position, so that the upper surface can be pressed down so as to substantially enclose the substrate 2 by the cover 102 in the covering position. In other words, the inclined and/or curved surface is high to low from the covering position to the non-covering position of the cover 102. More specifically, the inclined or curved, preferably inclined-and-curved, upper surface has a low side close to the mouthpiece side and a high side opposite the lower side. In other words, the high side is close to the covering position of the cover 102, and the low side is close to the non-covering position of the cover 102. The high side descends towards the low side across the upper portion 1011. In other words, the low side rises up or climbs up to the high side across the upper portion 1011. The cover 102 connects and presses the high side of the upper surface of the upper portion 1011 when in the covering position. With the pressure from the cover 102 at the covering position, the substrate 2 is substantially enclosed, preferably compressed, by the upper portion 1011 and the lower portion 1012, and the substrate cannot be discarded from and/or moved into the aerosol generation chamber 101.

FIG. 4*b* shows the aerosol generation chamber 101 in the open state and the cover 102 in the non-covering position.

The cover 102 is slid to the non-covering state. Specifically, the cover is moved to or beyond the low side of the upper surface of the upper portion 1011. As mentioned above, the upper surface of the upper portion 1011 is an inclined and/or curved surface. A virtual plane 23 (shown with dashed line in FIG. 4*a*) connecting the low side and the high side of the upper surface 1011 has a predetermined angle ∠b, namely the chord angle of the upper surface of the upper portion 1011, with the sliding direction line 22 of the cover 102. The angle is arranged in the way that when the cover 102 is slid to the position of the low side of the upper surface, the exposed area or space of the aerosol generation chamber 101 is large enough so that the substrate 2 can be discarded from the aerosol generation chamber 101. More specifically, with the expansion force of the expansion mechanism 1013, the open side of the aerosol generation chamber 101 is lifted up and opened so that the substrate 2 can be discarded from the aerosol generation chamber 101 by the fingertips of the user at the hinged side of the aerosol generation chamber 101.

Figure 5A:
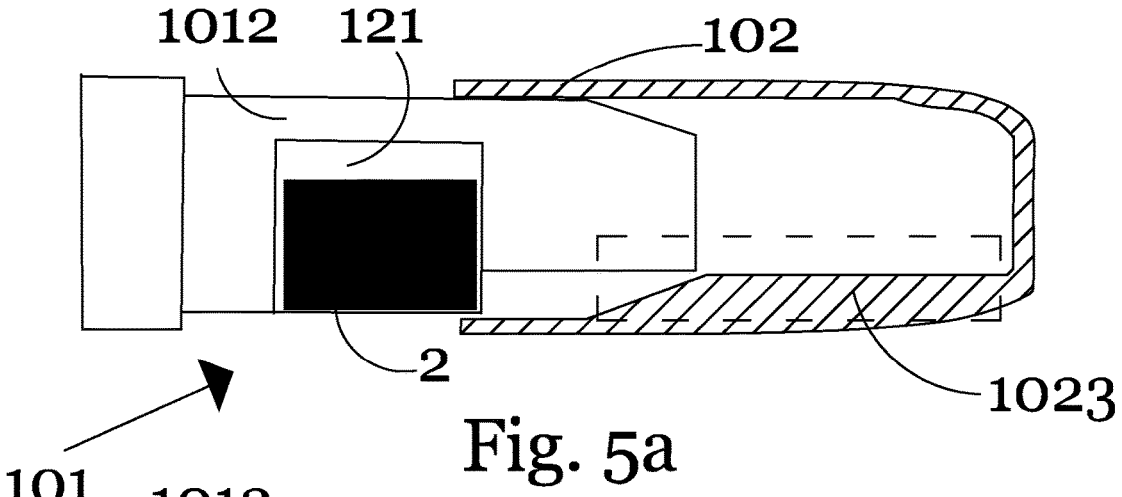
FIGS. 5*a* and 5*c*: show partial schematic views (cross-sectional views) of the aerosol generation chamber with a restriction portion of the aerosol generation device according to different exemplary embodiments of the present invention.
Figure 5B:
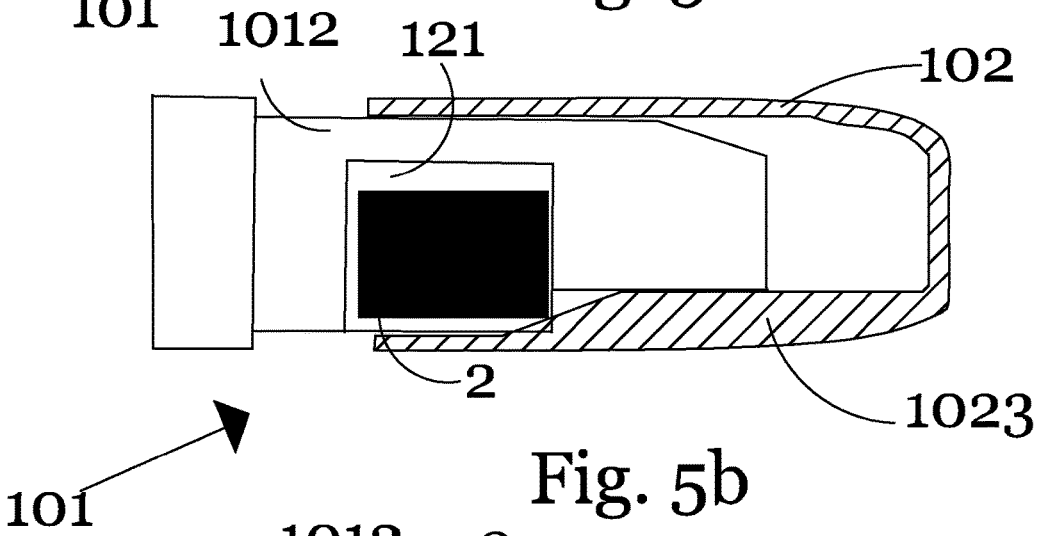
Figure 5C:
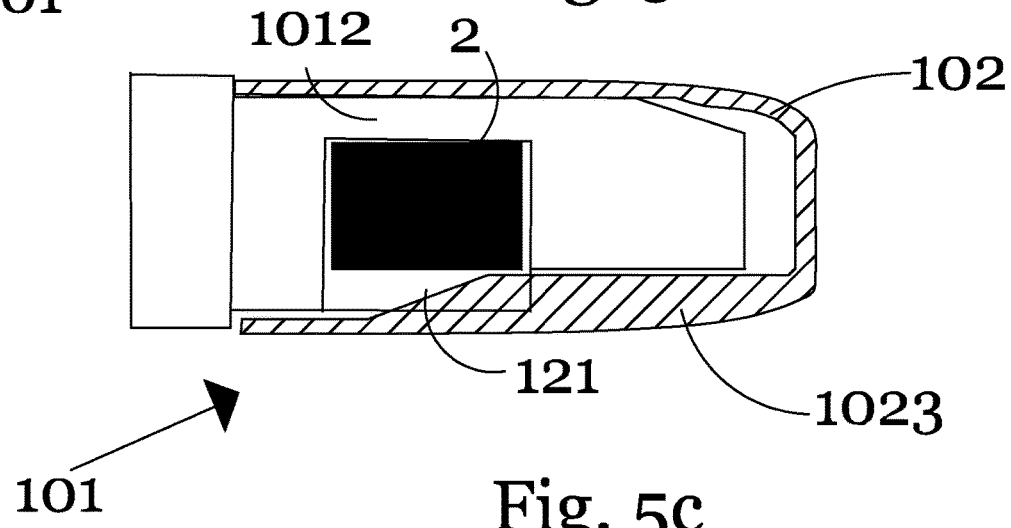

In order to fully maintain the substrate 2 in the aerosol generation chamber 101, the cover 102 comprises a restriction portion 1023 (shown in the dashed rectangle) for pushing the substrate 2 into the aerosol generation chamber 101 from the non-covering position to the covering position as shown in FIGS. 5*a* to 5*c*. The restriction portion 1012 is a protrusion set inside the cover at a position corresponding to the open side of the aerosol generation chamber 101. A hollow portion is arranged in the upper portion 1011 and/or the lower portion 1012 at a position relative or corresponding to the restriction portion 1012 of the cover 102, so that the restriction portion 1012 can slide along the aerosol generation chamber from the tip end thereof into the volume inside the aerosol generation chamber 121. An inclined surface is configured with the protrusion 1023 so as to push the substrate 2 smoothly into the volume 121 enclosed by the upper portion 1011 and the lower portion 1021, specifically the position where the heating elements 1016 are arranged.

The invention claimed is:

1. An aerosol generation device comprising:

an aerosol generation chamber configured to receive and heat a substrate to generate aerosol, wherein the aerosol generation chamber comprises an upper portion, a lower portion and a spring steel framework arranged between the upper portion and the lower portion, which is configured to receive and hold the substrate, wherein the aerosol generation chamber is moveable between a closed state in which a surface of the upper portion and a surface of the lower portion substantially enclose a volume configured to contain the substrate for consuming the substrate, and an open state in which the surface of the upper portion and the surface of the lower portion are distanced from each other by the spring steel framework, so that the substrate can be received by or removed from the chamber; and a cover having a covering position and a non-covering position; wherein when the cover is in the non-covering position, the volume inside the aerosol generation chamber is exposed and the aerosol generation chamber is in the open state, and when the cover is in the covering position, the aerosol generation chamber is covered by the cover and is in the closed state.

2. The aerosol generation device according to claim 1, wherein the cover is engaged with the upper portion so as to transition the aerosol generation chamber from the open state to the closed state or vice versa when the cover moves from the covering position to the non-covering position or vice versa.

3. The aerosol generation device according to claim 2, wherein the cover is configured to slide on a main body of the aerosol generation device and is slidingly engaged with the upper portion of the aerosol generation chamber, so that the cover is configured to press down the upper portion or release the upper portion so as to bring the upper portion closer to the lower portion or distance the upper portion from the lower portion via the spring steel framework when sliding on the main body.

4. The aerosol generation device according to claim 3, wherein an upper surface of the upper portion is configured to connect with the cover, and the upper surface is an inclined and/or curved surface, so that the upper portion is configured to be pressed down so as to substantially enclose the substrate by the cover in the covering position, and is configured to be released from the pressure of the cover through sliding the cover to its non-covering position.

5. The aerosol generation device according to claim 1, wherein the spring steel framework comprises an ejection plate configured to at least partially push the substrate out of the aerosol generation chamber when the aerosol generation chamber is opened.

6. The aerosol generation device according to claim 5, wherein the ejection plate forms a leaf or flat spring attached with the steel spring framework that is configured to push the substrate from the steel spring framework.

7. The aerosol generation device according to claim 1, wherein the spring steel framework is made of a steel frame or plate having a predetermined angle, and is configured to be compressed by an outer force.

8. The aerosol generation device according to claim 1, wherein the aerosol generation chamber comprises heating elements on the upper portion and/or the lower portion, for heating the substrate.

9. The aerosol generation device according to claim 8, wherein an attaching surface of the spring steel framework is attached to the upper portion, and a holding surface of the spring steel framework for holding the substrate is arranged opposite to the attaching surface, so that the holding surface is able to be sprung away from the heating element of the upper portion when the aerosol generation chamber is opened.

10. The aerosol generation device according to claim 1, wherein the spring steel framework is slidingly attached to the upper portion so that the spring steel framework is removable from the aerosol generation chamber.

11. The aerosol generation device according to claim 1, wherein the lower portion and/or the upper portion are rotationally hinged in the device.

12. The aerosol generation device according to claim 1, wherein the cover comprises a limiting portion for pushing the substrate into the aerosol generation chamber and fully maintaining the substrate in the aerosol generation chamber.

13. The aerosol generation device according to claim 1, wherein the substrate is compressed when the aerosol generation chamber is in the closed state.

* * * * *